US007556191B2

(12) United States Patent
Hewitt et al.

(10) Patent No.: US 7,556,191 B2
(45) Date of Patent: Jul. 7, 2009

(54) RUPTURABLE OPENING FOR SEALED CONTAINER

(75) Inventors: Stephen J. Hewitt, Kalamazoo, MI (US); Kara Marie Gustafson, Kalamazoo, MI (US); Manfred F. Maurer, Maineville, OH (US); Ron Duane Norwood, Plainwell, MI (US); Alexander Craig Bushman, Loveland, OH (US)

(73) Assignee: Evergreen Packaging, Inc., Cedar Rapids, IA (US)

( * ) Notice: Subject to any disclaimer, the term of this patent is extended or adjusted under 35 U.S.C. 154(b) by 781 days.

(21) Appl. No.: 10/892,961

(22) Filed: Jul. 16, 2004

(65) Prior Publication Data

US 2005/0258222 A1 Nov. 24, 2005

Related U.S. Application Data

(63) Continuation-in-part of application No. 10/848,207, filed on May 18, 2004.

(51) Int. Cl.
*B65D 25/54* (2006.01)
*B65D 77/28* (2006.01)
*B31B 1/25* (2006.01)

(52) U.S. Cl. ..... 229/103.1; 229/204; 229/237; 220/705; 239/33

(58) Field of Classification Search ..... 229/103.1, 229/243, 204, 237, 244; 215/388; 220/705, 220/709; 239/33; 426/85; 493/58, 160
See application file for complete search history.

(56) References Cited

U.S. PATENT DOCUMENTS

| | | | | |
|---|---|---|---|---|
| 3,361,611 A | | 1/1968 | Stark | |
| 3,494,536 A | * | 2/1970 | Henry | 229/117 |
| 3,596,829 A | | 8/1971 | Gardner | |
| 3,687,358 A | | 8/1972 | Wink et al. | |
| 3,907,193 A | * | 9/1975 | Heller | 428/156 |
| 4,429,828 A | | 2/1984 | Farber | |
| 4,438,865 A | | 3/1984 | Scattaregia | |
| 4,553,693 A | | 11/1985 | Terajima et al. | |
| 4,660,737 A | | 4/1987 | Green et al. | |
| 4,762,514 A | | 8/1988 | Yoshida | |
| 4,834,244 A | * | 5/1989 | Masui | 229/237 |
| 5,054,684 A | | 10/1991 | Farber et al. | |
| 5,147,065 A | | 9/1992 | Rush et al. | |
| 5,348,217 A | | 9/1994 | Bettle, Jr. et al. | |
| 5,397,023 A | | 3/1995 | Toczek et al. | |
| 5,997,177 A | | 12/1999 | Kaufman | |
| 6,368,539 B1 | * | 4/2002 | Greenfield et al. | 264/284 |
| 6,783,019 B2 | * | 8/2004 | Zettle et al. | 220/254.3 |
| 2002/0145000 A1 | * | 10/2002 | Li | 220/709 |
| 2004/0149755 A1 | * | 8/2004 | Olivar | 220/212 |

FOREIGN PATENT DOCUMENTS

| | | | |
|---|---|---|---|
| EP | 278625 A1 | * | 8/1988 |
| WO | WO 9420003 A2 | * | 9/1994 |

* cited by examiner

*Primary Examiner*—Gary E Elkins
*Assistant Examiner*—Christopher Demeree
(74) *Attorney, Agent, or Firm*—Pitts & Brittian, P.C.

(57) ABSTRACT

A container formed from a paperboard laminate and including a rupturable opening for gaining access to the contents of the container, the opening being defined by an embossment pattern in a wall of the container. The embossment defines a weakened area which includes the layers of the laminate, but without destruction or deterioration of selected ones of the barrier/sealing layers of the laminate. A method is disclosed.

11 Claims, 8 Drawing Sheets

RUPTURABLE OPENING FOR SEALED CONTAINER

CROSS-REFERENCE TO RELATED APPLICATIONS

This application is a continuation-in part of a pending non-provisional application Ser. No. 10/848,207 filed on May 18, 2004.

STATEMENT REGARDING FEDERALLY SPONSORED RESEARCH OR DEVELOPMENT

Not Applicable

FIELD OF INVENTION

This invention relates to rupturable openings useful for gaining access to the contents of a closed (sealed) container and methods for forming the same.

BACKGROUND OF INVENTION

Liquid comestibles, commonly are offered to the consumer contained within closed (sealed) containers formed from laminates which include a paperboard substrate having at least one or more outer barrier layers. Such barrier layers insulate the paperboard from access to moisture originating either internally or externally of the container. At times, the barrier layer(s) further bar or reduce the transfer of gas through the container wall. The outer layer, at times, may comprise a heat sealing layer, which may also serve a barrier function.

Access to the contents of the container is commonly afforded by inserting a common drinking straw through an opening defined in the wall of the top end of the container. Such areas have heretofore taken many forms, such as multiple slits radiating from a central point and extending partially or fully through a wall of the container, partial perforations through the container wall, or other techniques. Most commonly, such areas are defined employing cuts partially through the thickness of the container wall, thereby permitting the rupture of the area using a common drinking straw, for example, to thereby gain access to the interior of the container. Also, the prior art includes the technique of providing slits or cuts through most or all of the thickness of the wall of the container, with these slits or cuts being temporarily sealed with a removable patch, cover, or a flap of the container.

It is noted that in the industry there exists containers for comestibles such as milk for example, wherein the container is of a lidded cup geometry. However, in certain of these containers, the opening for gaining access to the contents of the container is located at the bottom of the container, i.e., at that end of the container opposite the lid. In the present disclosure, the term "top wall" of the container is to be construed as referring to that wall of the container through which access to the contents of the container is achieved employing an opening as disclosed herein. Thus, in the aforedescribed lidded cup, the "top wall" of such container would include the actual bottom wall of the cup.

These prior art techniques for weakening the container wall for insertion of a drinking straw, for example, suffer from various problems. Obviously, unsealed full cuts through the thickness of the container wall are impermissible. Weakening an area of the container wall by cutting partially through the thickness of the wall requires precise cutting of the blank from which the container is ultimately formed. Known commercial production equipment used for this purpose has been found unreliable for producing such partial thickness cuts. Such unreliability is exacerbated by variances in the thickness of the laminate being cut as well as other factors.

Attempts have been made in the prior art to produce weakened areas in the container wall by embossing a pattern in the container wall. In certain containers formed from paperboard laminates and intended to contain a liquid, it is permissible that one or more, but less than all, of the layers of the laminate to be ruptured in the course of defining an opening to be used for future access to the contents of the container. This is true, for example, with containers for liquids having a short shelf life, such as milk. With containers for other liquids such as orange juice, it is impermissible that the liquid in the container be allowed access to the fibers of the paperboard substrate of the laminate. Known embossing patterns and their techniques of production have been found to rupture the outer layers of barrier or sealing materials that are laminated to one or both of the opposite surfaces of a paperboard substrate, thereby exposing the absorbent fibers of the paperboard to soak up liquid from inside the container, or to soak up liquid from the exterior of the container, either such event destroying the ability of the laminate to contain the contents of the container within the container, or permitting inadvertent puncture of the weakened area of the container wall. In more severe instances, leakage of the container contents results, while in any such instance, the purity, flavor, etc. of the container contents may be compromised. Whereas, as noted, rupture of one or more of the barrier or sealing layers of a paperboard laminate to be used to form containers for liquids, is permissible in certain containers, such layer rupture is not permissible in other containers for liquids. Known prior art techniques, including known embossment patterns, have been found to be lacking in their ability to consistently provide a weakened area in a wall of a container for liquids employing a paperboard laminate, wherein the weakened area remains intact to the extent necessary to retain the contents within the container and/or to protect the contents of the container against undesired alterations of the contents of the container, and still is readily rupturable by a common drinking straw.

SUMMARY OF INVENTION

In accordance with one aspect of the invention, a blank comprises a substrate having a plurality of score lines. The substrate is configured to be folded along the plurality of score lines to form a sealed enclosure. A structurally weakened area is defined on a portion of the substrate. The structurally weakened area comprises a plurality of embossments configured to be produced by a pair of male die inserts acting on opposed sides of the substrate. The structurally weakened area includes a thickness that is substantially less than a thickness of the substrate. The structurally weakened area is configured to be ruptured upon applying a force thereto to permit access to an interior region of the sealed enclosure.

In accordance with another aspect of the invention a container comprises a blank having a paperboard layer that has opposed surfaces. The blank is configured to be integrally folded to form a sealed enclosure having a top wall, a bottom wall, and sidewalls. A plurality of barrier and sealing layers disposed on at least one of opposed surfaces of the paperboard layer. A structurally weakened area is defined on a portion of the top wall. The structurally weakened area comprises a plurality of embossments configured to be produced by a pair of male die inserts. Each of the plurality of embossments includes a thickness that is substantially less than a thickness of the substrate, the plurality of embossments further include a selected geometry such that the plurality of the barrier and sealing layers remains functionally intact when the laminate is embossed. The structurally weakened area is configured to be ruptured upon applying a force against the structurally weakened area at the location of the plurality of the embossments.

In accordance with a further aspect of the invention, a blank-forming apparatus produces embossments on the portion of the blank. The apparatus comprises a plurality of die cylinders and configured to be mounted longitudinally on the blank-forming apparatus. A plurality of die inserts having a plurality of embossments is releaseably mounted in the longitudinal direction on the plurality of die cylinders. The plurality of die inserts is configured to cooperate with one another to produce a structurally weakened area on the portion of the blank passed therebetween.

In accordance with yet another aspect of the invention, a method of making a blank is provided. The method includes the steps of providing a substrate having a plurality of score lines and producing a pattern of embossments on the substrate by using a pair of male die inserts. The pattern of embossments is defined by a plurality of shallow indentation embossments intersecting one another. The locus of intersection of the plurality of shallow indentation embossments defines a structurally weakened area having a lesser resistance to rupture than the remainder of the pattern of the embossments.

DETAILED DESCRIPTION OF INVENTION

The present invention relates to a container particularly useful for containing a liquid comestible which is intended to be accessed and withdrawn from the interior of the container via a common drinking straw which is also employed to rupture a relatively small weakened area in a wall (usually the top wall) of the container and thereby permit the passage of the straw into the interior of the container, all as is well known in the prior art and need not be described in detail.

Figure 3:
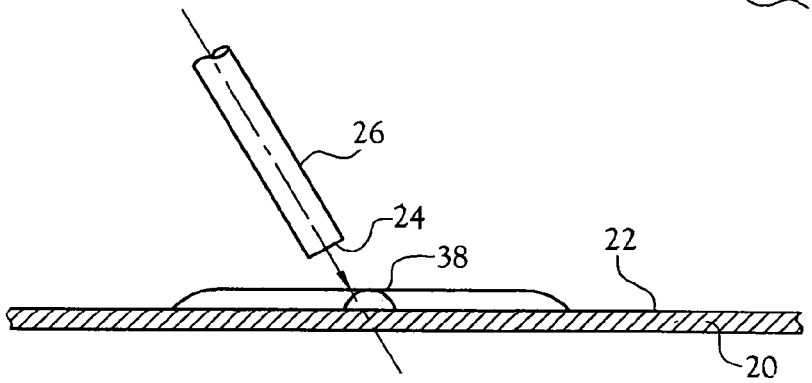
FIG. 3 is a cross-sectional view taken along line 3-3 of FIG. 2, of a portion of the top wall of a container and including an embossment pattern embodying various aspects of the present invention plus a depiction of a drinking straw poised for rupture of the depicted embossment.
Figure 4:
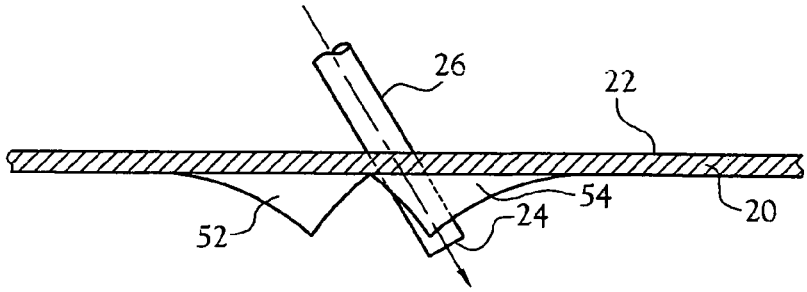
FIG. 4 is a side elevation view of a portion of a container wall as depicted in FIG. 3 and schematically depicting the penetration of the wall with a drinking straw via a rupturable opening in the wall employing various aspects of the present invention.

FIGS. 3 and 4 depict a portion 20 of the top wall 22 of a container and the entry of the end 24 of a straw 26 into the interior of the container via a weakened area 38 in the wall of the container, the weakened area being ruptured using the end of the straw.

In one embodiment of the present invention, the paperboard laminate 10 (FIGS. 13 and 14) comprises a paperboard substrate 12 having a thickness of between about 15 and about 17 mils for example. In a typical paperboard laminate as used in the formation of containers for liquids, at least one, and commonly both, of the opposite surfaces 14, 16 of the paperboard has bonded thereto a barrier layer 18, 19, commonly of a polymeric material, such as polyethylene which also may serve as a barrier against the entry into, or passage through, the wall of the container of gas(es) or liquid(s) and/or as a sealant in the formation of the blank into a container. This barrier or sealing layer commonly may be about 25 microns thick, for example. Whereas the laminates depicted in FIGS. 13 and 14 include only two and three layers, respectively, it will be recognized that the laminate may include additional layers, as desired or needed for a particular application of the laminate.

Figure 1:
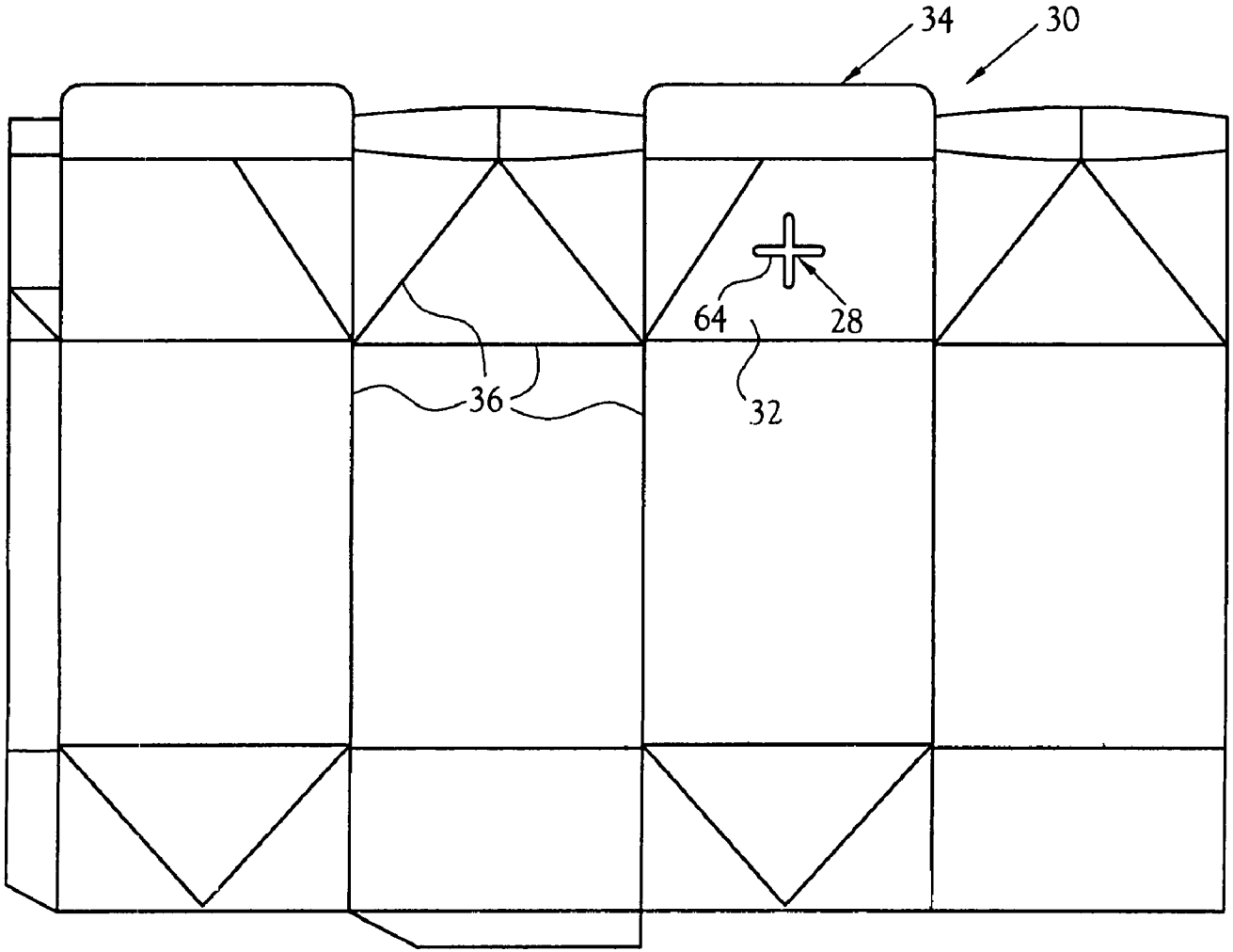
FIG. 1 is a laid out view of one embodiment of a blank useful for forming a container having a rupturable area defined in the top wall thereof according to the present invention.

FIG. 1 depicts a typical blank 30 employed in the formation of a common gable top container which includes one embodiment of an embossment pattern 28 defined in one panel 32 of the top end 34 of the blank which ultimately becomes the top end of a container. The depicted blank includes various fold lines 36, for example, commonly formed as score lines into the thickness of the blank.

Referring to FIGS. 2-5, in accordance with one aspect of the present invention, a wall 22 of a container for a liquid comestible, for example, is provided with a structurally weakened area 38 designed to be ruptured using a common drinking straw 26. In the present invention this weakened area takes the form of an embossment 40 defined in the wall of the container and which includes at least first and second generally elongated (e.g., linear) portions 42 and 44, respectively, which intersect 46 one another, for example at their approximate midpoints. In the depicted, and preferred, embossment, each of the linear portions of the embossment is of a substantially semi-circular cross-section as seen in FIGS. 3, 5, 13, and 14. As a consequence of their formation by embossing, each of the linear sections is weakened to a first degree and subject to ready rupture. Of importance in the present invention, through the use of such intersecting linear, semi-circular cross-sectional, portions 42, 44 of the embossment, the present inventor provides an area within the intersection 46 of the linear portions which is weakened to a second degree which provides lesser resistance to rupture than the resistance to rupture of the remainder of each of the linear portions of the embossment. Thus, the present embossment pattern provides an area within the embossment pattern which is readily ruptured by applying a force thereagainst using the end of a common drinking straw to provide ready and easy initial commencement of a rupture of the weakened intersection of the generally linear embossments. Once a rupture of the weaker intersection area has commenced, less force is required to extend the rupture laterally of the intersection area into those regions of the linear portions which emanate from the intersection area of the embossment pattern. The resultant displacement of ruptured portions 52, 54 of the embossment pattern after a straw has been inserted into the interior of the container is depicted in FIG. 4.

Figure 2:
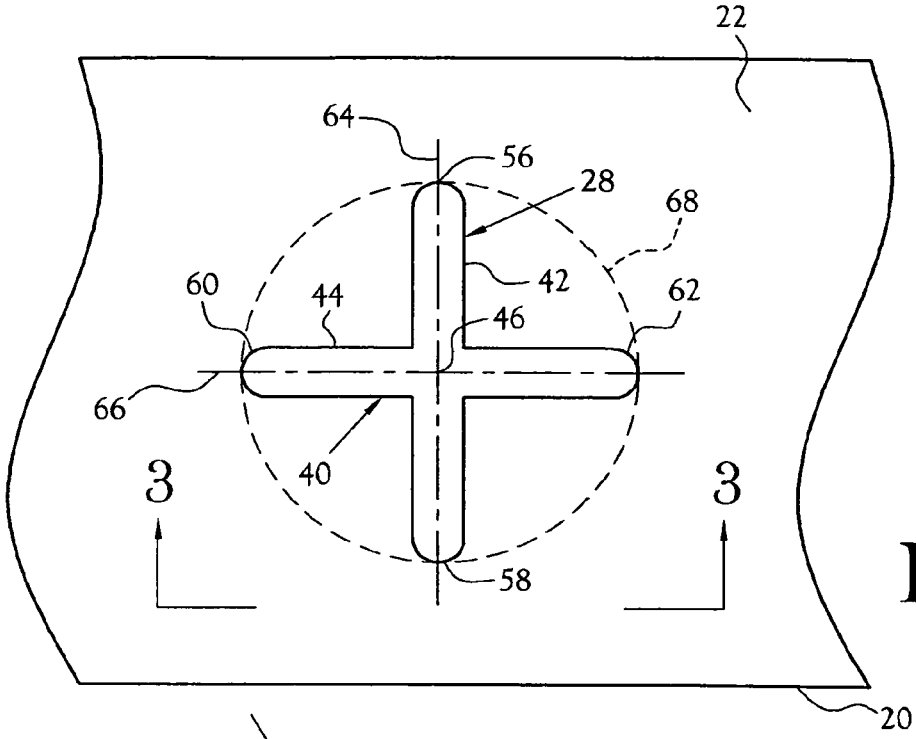
FIG. 2 is a top view of one embodiment of an embossment pattern of the present invention.

In accordance with one aspect of the present invention, the pattern of embossment is chosen to include at least first and second generally linear portions 42, 44 which mutually intersect, preferentially bisect, one another. The linear portion 42, 44 is preferably rotated at the 45 degree angle to the fiber orientation of the paperboard substrate. This orientation ensures that the rupturing force acts uniformly on the fibers. It is anticipated, however, that more than two linear portions may be employed, but are not required. Preferably, the linear portions are each of equal length, but different lengths of linear portions may be employed, including, for example, alternating lengths. In the embodiment depicted in FIG. 2, the terminal ends 56, 58 of the first linear position 42, and 60, 62 of the second linear portion 44 are each tapered down and/or rounded, to decrease the likelihood of any rupture of the weakened area extending beyond the terminus of each linear portion. In a typical embodiment, the centerline 64 of each linear portion of an embossment intersects, and preferably bisects, the centerline 66 of each other linear portion of the embossment pattern. In the embodiment of FIG. 2, the termini of the two linear portions lie within an imaginary circle 68 which is concentric with the point of intersection 46 of the linear portions. In any event, the diameter of the imaginary circle (FIG. 2) exceeds the diameter of the straw to be used in rupturing the weakened area, but does not exceed such minimum diameter to the extent that liquid will readily leak from the container when the straw is inserted into the interior of the container. In a typical container, the diameter of the imaginary circle will range between about 0.4 and about 0.6 inch in diameter. Further, whereas it is preferred that each of the linear portions of the embossment be of the same geometry, including the same width, it will be recognized that combinations of linear portions of differing widths may be employed. Examples of differing arrangements of linear portions 78-88 of the embossments 70-79, respectively, are depicted in FIGS. 5-11.

As seen in FIGS. 3, 5, 13, and 14, each linear portion of the embossment of the present invention is of a semi-circular cross-section. In a typical embodiment employing a paperboard laminate of 16 mils thickness, the width "$W_1$" of each linear portion is chosen to be about 0.039 inch. Likewise, the height "$H_1$" of each linear portion is chosen to be about 0.006 inch. In this example, the area of the weakened portion (intersection) of the embossment pattern is about 0.002 $in^2$. In this embodiment, a rupture force of about 4.7 lbf (mean value) applied to the weakened area, using a 4 mm diameter drinking straw readily ruptured the embossment.

Figure 5:
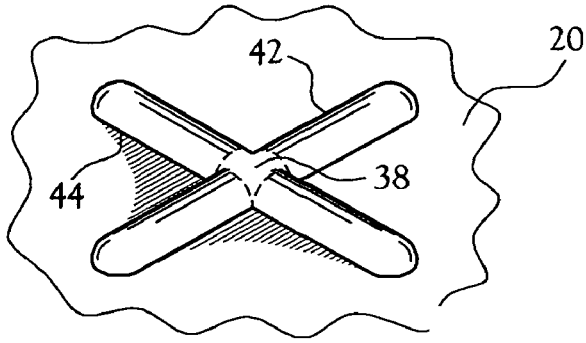
FIG. 5 is a perspective view of an embossment in a container wall and embodying various features of the present invention.
Figure 6:
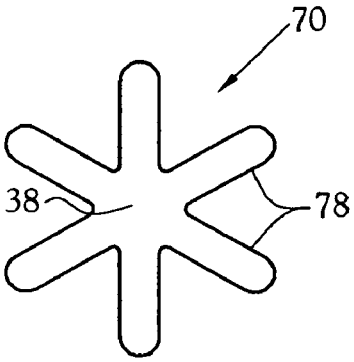
FIG. 6 is a representation of an alternative embossment pattern embodying various of the features of the present invention.
Figure 7:
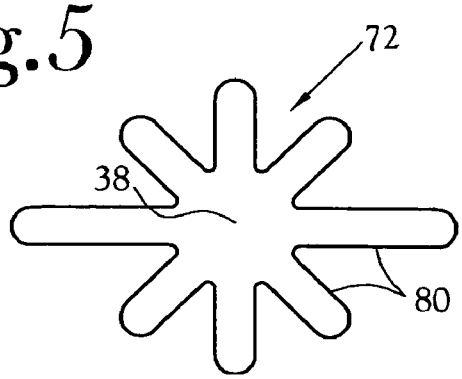
FIG. 7 is a representation of an alternative embossment pattern embodying various of the features of the present invention.
Figure 8:
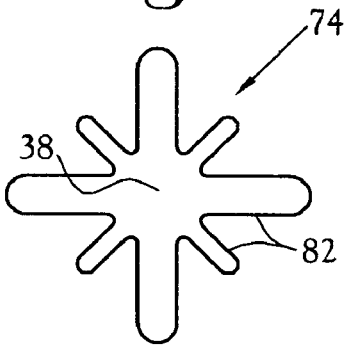
FIG. 8 is a representation of an alternative embossment pattern embodying various of the features of the present invention.
Figure 9:
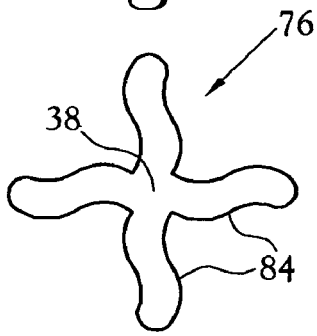
FIG. 9 is a representation of an alternative embossment pattern embodying various of the features of the present invention.
Figure 10:
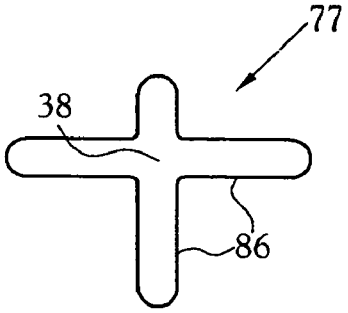
FIG. 10 is a representation of an alternative embossment pattern embodying various of the features of the present invention.
Figure 11:
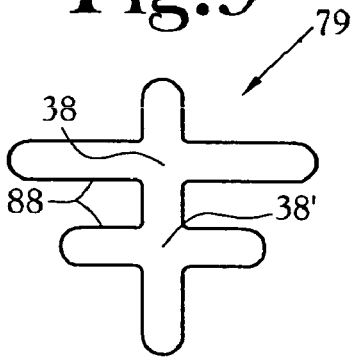
FIG. 11 is a representation of an alternative embossment pattern embodying various of the features of the present invention.

Referring to FIG. 5 in particular, it will be seen that the intersection 46 of the multiple linear portions 42, 44 of the embossment pattern produces an area 38 within and preferably about the center of the pattern the pattern which is a combination of the widths of the individual ones of the linear portions. This structure defines a type of weak bridge 90 (see FIGS. 13 and 14) over the intersection which comprises stressed, but integral, paperboard laminate. The present inventors have found that this enlarged and weakened area offers less resistance to rupture than the remainder of each of the linear portions of the embossment. Thus, when the end of a common drinking straw is forced against such enlarged area 38, there occurs immediate and ready initial rupture of the enlarged area. This rupture is readily spread laterally from the enlarged area along each of the linear portions to create an opening sufficient for the entry of the end of the straw fully into the interior of the container for the withdrawal of the container contents via suction applied to the opposite end of the straw.

Figure 12:
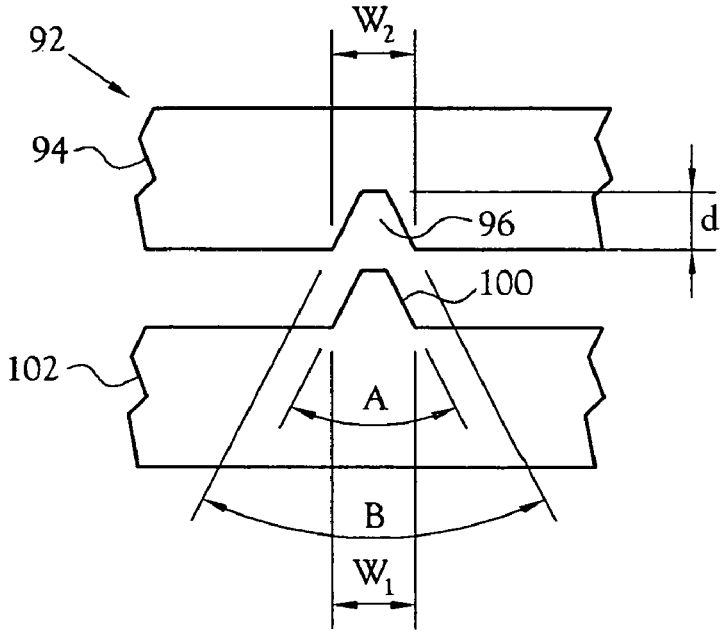
FIG. 12 is a side elevational view, in section, of a typical die employed in the formation of an embossment of the present invention.
Figure 15:
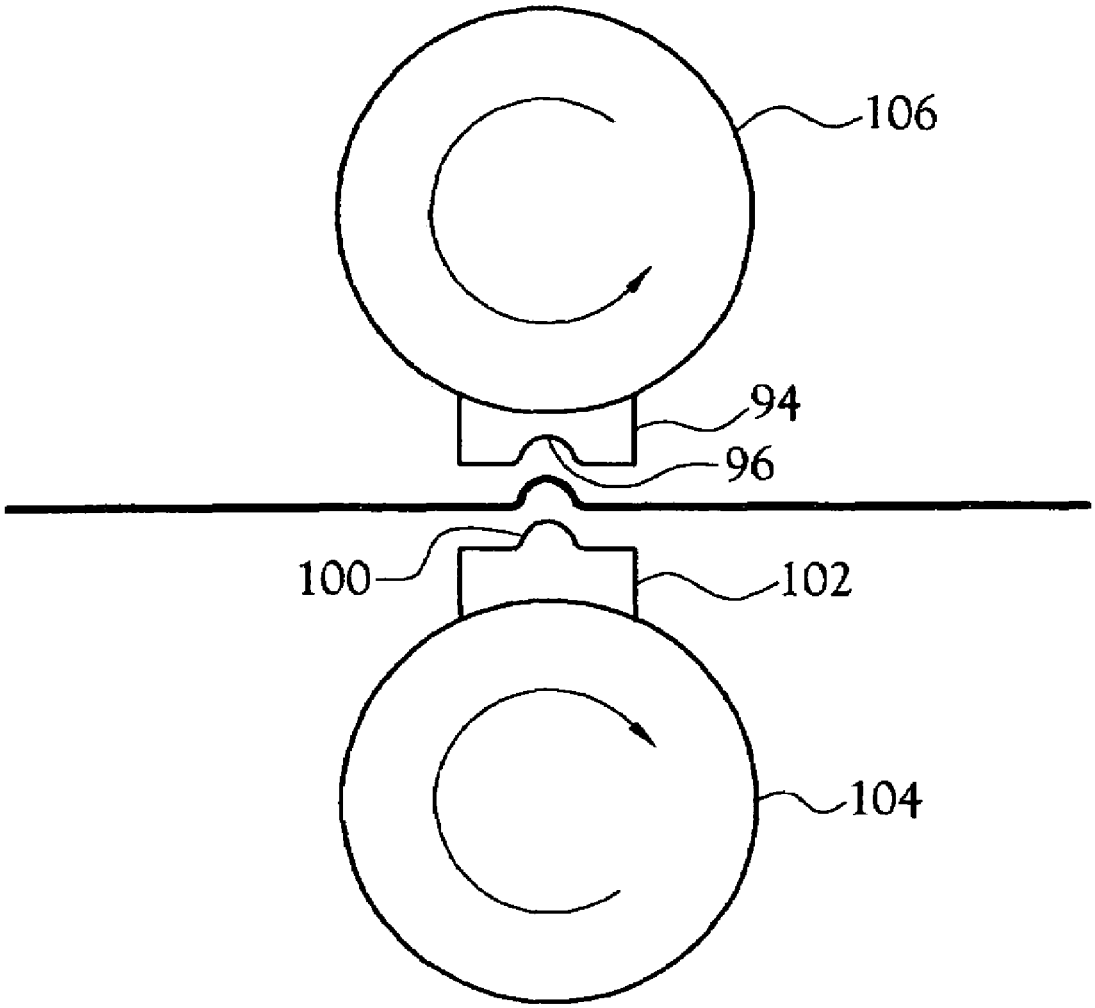
FIG. 15 is a schematic representation of one embodiment of apparatus for embossing a laminate in accordance with the present invention.
Figure 16:
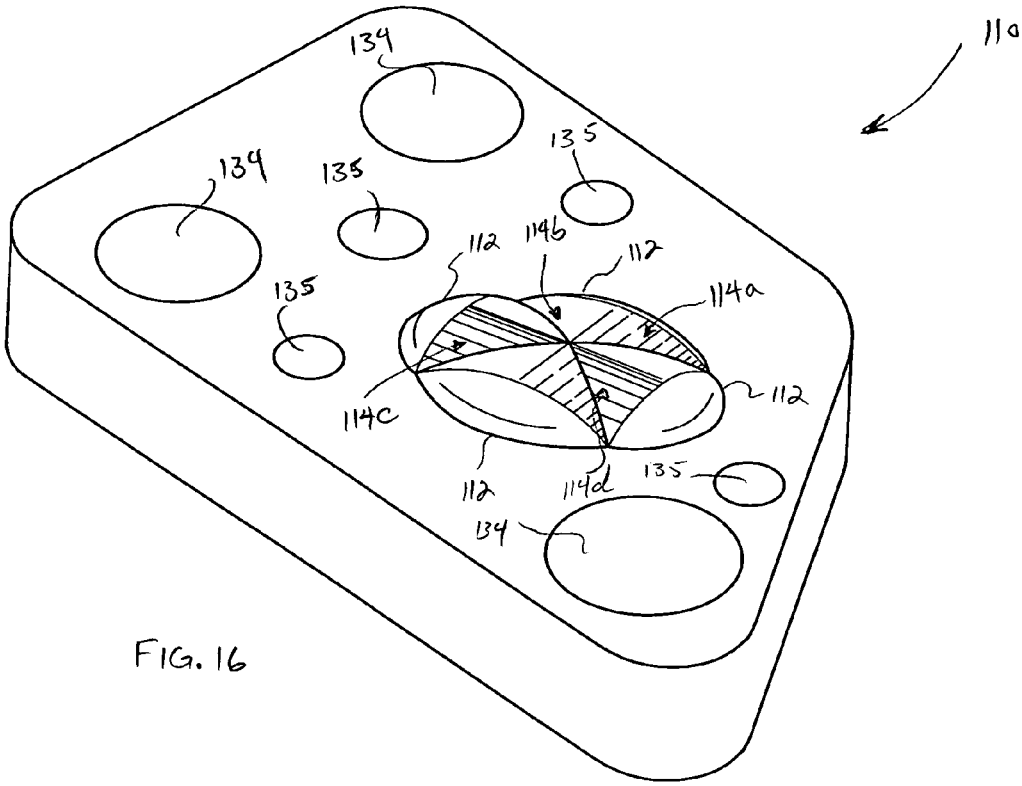
FIG. 16 is a perspective view of a second embodiment of an embossment pattern of the present invention.

Importantly, in the present invention, each pattern of embossment is imparted to a blank 30 prior to erection of the blank into a container. To this end, the present inventor has found that formation of the desired embossment of semi-circular cross-section is formed employing a male and female die set. A cross-sectional view of one suitable die set 92 is depicted in FIGS. 12 and 15. In this die set, the female die 94 is provided with a cavity 96 of truncated pyramidal cross-section which is adapted to receive therein a portion of the laminate paperboard blank which is forced into the cavity by a matching projection 100 of truncated pyramidal cross-section of the male die 102. In one embodiment, the height h, of the projection is about 22% shorter than the depth of the female die cavity. Further, the width of the base of the projection of the male die is about 19% narrower than the width of the mouth of the cavity in the female die. These dimensional relationships provide substantially uniformly distributed pressure applied to the paperboard laminate interposed between the male and female dies, hence uniform displacement of laminate paperboard and formation of an embossment pattern whose components are each of uniform thickness. Further, these dimensional relationships, employing a female die cavity and a male projection of truncated pyramidal cross-section form an embossment of substantially semi-circular cross-section. In a preferred embodiment, each embossment preferably does not extend above the plane of an outer (or inner as the case may be) surface of the laminate paperboard by a distance greater than the approximate thickness of the laminate paperboard. The final height of the embossed portion of the laminate paperboard is chosen by limitation of the extent of closing of the die set, a function which is readily accomplished and which has been found to provide the uniformity of displacement of the paperboard laminate out of its sheet form and into the embossment. Male and female dies are incorporated into existing container blank-forming machines, and are relatively inexpensive, so that their use in the present invention represents relatively little added cost to the production of container blanks. More importantly, the use of male and female dies provides that control over the uniformity of displacement of the paperboard laminate during formation of the embossment which is necessary for automated production of container blanks. Still further, employing dies which define embossments of semi-circular cross-section has been found to provide an unanticipated benefit relative to the ability to selectively control the extent or degree of destruction of the outer polymeric layer(s) of the laminate paperboard, hence the absence of spoilage, contamination, etc. of the contents of a container having a rupturable area in accordance with the present invention. Still further, such retained integrity of the outer layers of the laminate paperboard precludes the leakage of liquid, either from exteriorly or interiorly of the container, from being absorbed by exposed fibers of the paperboard itself, and resultant potential failure of the strength of the container, among other things. Notably, the present inventors have found that embossing the paperboard laminate between male and female dies having a truncated pyramidal female die cavity and a complimentary geometry male die projection, squeezes the laminate therebetween in a manner which provides the desired substantially semi-circular cross-sectional geometry of the embossment without rupture of any outer layer of the laminate, or with limited rupture of one or more, but not all, the layers of the laminate.

Figure 13:
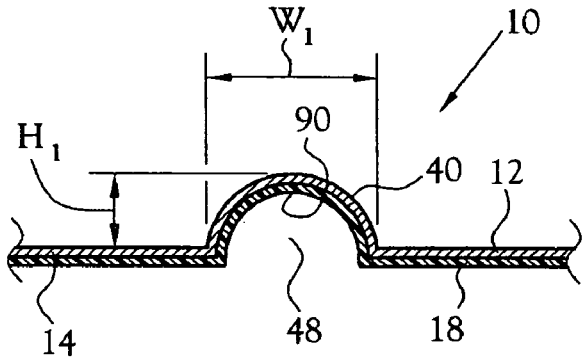
FIG. 13 is a cross-sectional view of a portion of a laminate paperboard useful in the present invention.
Figure 14:
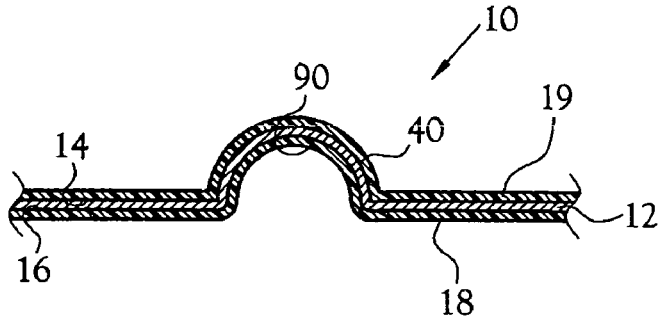
FIG. 14 is a cross-sectional view of a portion of a further laminate paperboard useful in the present invention.

In accordance with one aspect of the present invention, with reference to the apparatus schematically depicted in FIG. 15, there is provided a method for the formation of a rupturable area in the wall of a blank from which a container may be formed comprising the steps of disposing a portion of a laminate paperboard 10 having an outer layer of barrier or sealing material on at least one surface thereof, as depicted in FIGS. 13 and 14, between male and female dies 94 and 102, respectively, having respective projection 100 and cavity 96 features adapted to define an embossment of substantially semi-circular cross-section, and pressing said male and female dies together to that extent which defines said embossment, but which does not destroy or otherwise damage the integrity of said outer layer of barrier material or other layers of the laminate. In the apparatus depicted in FIG. 15, the male and female dies are mounted on the outer circumference of nip rolls 104 and 106, respectively, thereby providing for the embossment of succeeding blanks defined on a sheet of laminate paperboard which is continuously fed through the nip rolls.

In the preferred method, the laminate material of the container wall is embossed from the inside outwardly of the container. That is, the embossment projects from the outer surface of the container, as opposed to the embossment projecting inwardly of the container. This feature of the invention provides for cleaner rupturing of the weakened intersection of the rupturable area, followed by uniform spread of the rupture along the individual linear portions of the embossment. However, as desired, the embossment may be formed from outside inwardly of the container.

Figure 17:
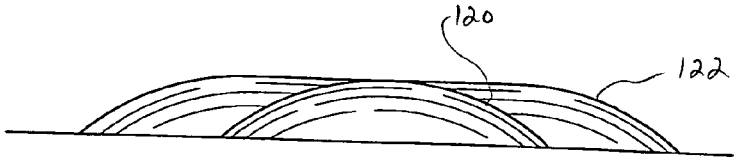
FIG. 17 is a side view of the embossment depicted in FIG. 16.
Figure 18:
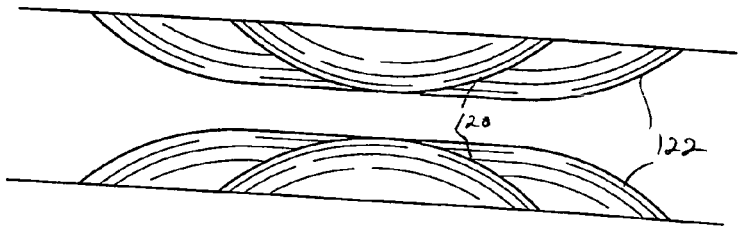
FIG. 18 is side views of a pair of male dies facing one another.
Figure 19:
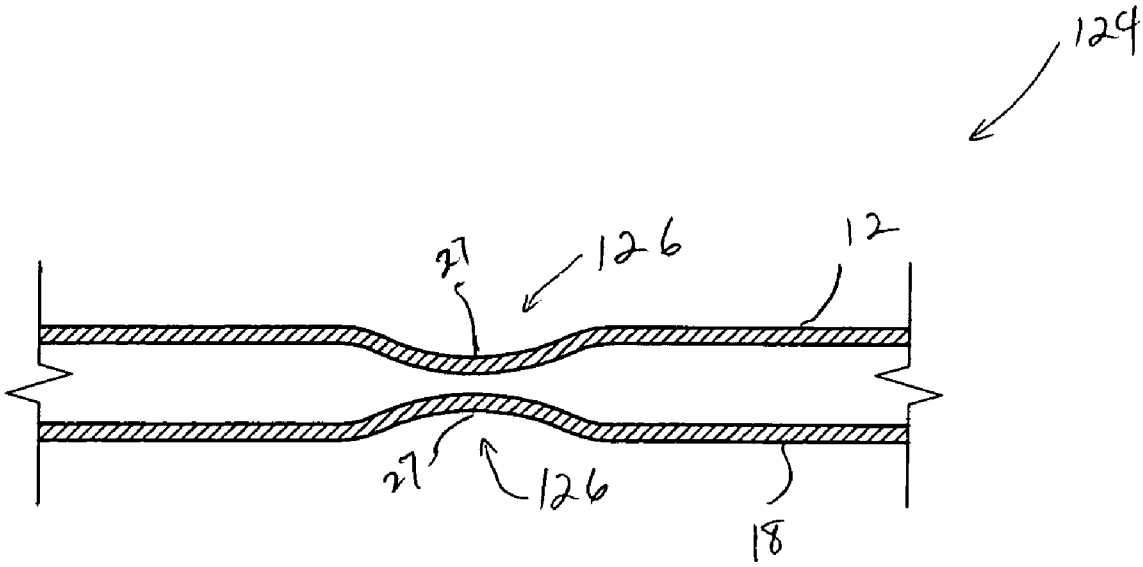
FIG. 19 is cross sectional view of a portion of a substrate useful in the second embodiment of the present invention.

Referring to FIGS. 16-20, one of a pair of male die inserts 110 is shown. The male die insert 110 includes a plurality of embossment 112. The plurality of embossments 112 includes four shallow indentation embossments 114*a*, 114*b*, 114*c*, and 114*d* which are intersecting one another. Each shallow indentation embossments 114*a-d* has a substantially semi-circular cross section 126 as depicted in FIG. 19.

FIG. 17 is shown the side view of the male die insert 110. It should be noted that each of the male die insert 110 is designed and fabricated such that they appear as two intersecting cylindrical surfaces 120 & 122. This special design ensures that when the two male die inserts compress on the blank, as shown in FIG. 18, the substrate is weakened within the blank and the polymer layer(s) remain intact during embossment.

Figure 20:
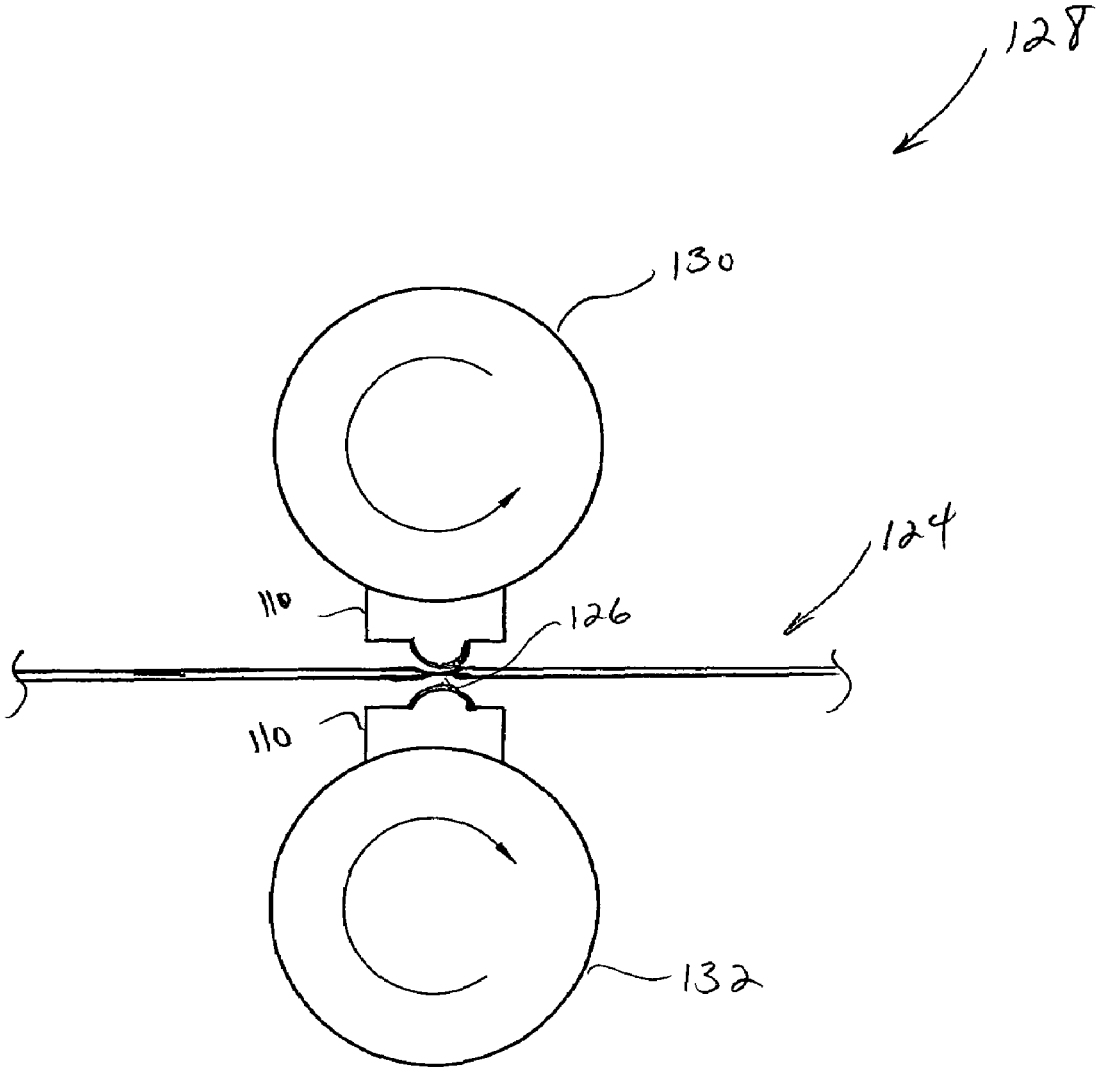
FIG. 20 is a schematic representation of the second embodiment of apparatus for embossing a blank in accordance with the present invention.

FIG. 19 illustrate the blank 30 having a structurally weakened area 38 with the second embodiment of the present invention. As shown in FIG. 20, when the two male die inserts 110 come together, they compress upon the blank and produce two smooth hemispheres 126 within the blank. The center of these hemispheres considered to be the weakest area 126 within the blank. The weakest area 126 resulted from two male die inserts 110 compressing on the blank and that stretches the substrate beyond its maximum allowable stress in one portion of the laminate. For example, the paperboard portion of the laminate has an elongation to break of about 2 to 3 percent, but other layers of the laminate, e.g., polyethylene layers has an elongation to break of 65 to 70 percent so that those layers are not damaged. In this way, rupturable layers can be engineered within the substrate structure.

FIG. 20 illustrate a blank-forming apparatus 128 for producing embossments on a portion of the blank. The apparatus comprises a plurality of die cylinders 130 and 132 configured to be mounted longitudinally on the blank-forming apparatus. A plurality of die inserts 110 having a plurality of embossments is releaseably mounted in the longitudinal direction on the plurality of die cylinders 130 & 132. The plurality of die inserts 110 is bolted through holes 134 and holes 35 are alignment holes. The plurality of die inserts is configured to cooperate with one another to produce a structurally weakened area on the portion of the blank passed therebetween.

It should be noted that the structurally weakened area 38 has a thickness that is substantially less than the thickness of the blank. Therefore, a force of about 4.7 lbf applied to the weakened area 38 will rupture the blank at the weakest area.

In accordance with the second embodiment of the present invention, a method for making the blank, as depicted in FIG. 20, is provided. In operation, the method comprises of providing a substrate having a plurality of score lines. Next, producing a pattern of embossments on the substrate by using a pair of male die inserts. The pattern of embossments is defined by a plurality of shallow indentation embossments intersecting one another. The locus of intersection of the plurality of shallow indentation embossments defines a structurally weakened area having a lesser resistance to rupture than the remainder of the pattern of the embossments.

Whereas the present invention has been described using specific values and terms, it is anticipated that one skilled in the art will recognize acceptable alternatives or modifications of the invention and it is intended that the invention be limited only as set forth in the claims appended hereto.

What is claimed is:

1. A blank for forming a sealed enclosure useful for containment of a liquid comprising:

a laminate including a substrate having first and second opposite surfaces and at least one other layer of disparate elongation to break property relative to said substrate, said elongation to break property of said at least one other layer being greater than the elongation to break property of said substrate, said laminate having a plurality of score lines, and being configured to be folded along said plurality of score lines to form a sealed enclosure;

a structurally weakened area defined on a portion of said first surface of said at least one other layer of disparate elongation to break property comprising a plurality of intersecting embossments produced by a pair of registered male die inserts acting simultaneously on opposed surfaces of said laminate, each of said embossments being of a continuous length and non-pervious to liquids over their length, said structurally weakened area including a thickness that is substantially less than a thickness of said substrate and wherein said structurally weakened area is configured to be ruptured upon applying thereto a puncturing force originated externally of said container to permit access to an interior region of the sealed enclosure; and said structurally weakened area remains unfolded during formation of the blank into the sealed enclosure.

2. The blank of claim 1 wherein said laminate further comprises an inner surface and an outer surface, an inner layer of a polymer coated on the inner surface of the laminate, an outer layer of a polymer coated on the outer surface of the laminate wherein the inner and outer layers are configured to resist a rupture force of about 4.7lbf applied to the structural weakening area of the plurality of embossments.

3. The laminate of claim 1 wherein said laminate further comprises an inner surface layer of polymer coated on the inner surface of the substrate and wherein the laminate is configured to resist a force of about 4.7lbf applied to the structurally weakened area.

4. The blank of claim 1 wherein the plurality of embossments further comprises embossments intersecting one another in the structurally weakened area and each embossment has a substantially semi-circular cross-sectional geometry.

5. The blank of claim 1 wherein the embossments project inwardly of said laminate and into the plane of the substrate to the extent that said substrate is at least partially ruptured and said at least one other layer remains intact.

6. A container comprising:

a blank having a paperboard layer, the paperboard layer includes opposed surfaces, the blank integrally folded to form a sealed container having a top wall, a bottom wall, and sidewalls;

a plurality of barrier and sealing layers disposed on at least one of said opposed surfaces of the paperboard layer, at least one of said plurality of barrier and sealing layers having an elongation to break property exceeding the elongation to break property of said paperboard layer, a structurally weakened area being defined on a portion of the top wall, said structurally weakened area comprising a plurality of embossments produced by a pair of male die inserts acting on opposed surfaces of the blank, each of said plurality of embossments having a thickness that is substantially less than a thickness of the laminate, the plurality of embossments further include a selected geometry such that the plurality of the barrier and sealing layers remains functionally intact when the laminate is embossed and wherein the structurally weakened area is ruptured upon applying a force against the structurally weakened area at the location of the plurality of the embossments; and said structurally weakened area remains unfolded during formation of the blank into the sealed container.

7. The container of claim 6 wherein the selected geometry includes a plurality of embossments intersecting one another and wherein each embossment has a substantially semi-circular cross section.

8. The container of claim 7 wherein the semi-circular cross section of each of the embossments is substantially constant in geometry over its length.

9. The container of claim 7 wherein said structurally weakened area is maximized at the intersection of said plurality of embossments.

10. The container of claim 6 wherein the embossments project inwardly of the laminate and into the plane of the paperboard layer.

11. The container of claim 6 wherein the puncture force applied to the structurally weakened area has a magnitude of at least 4.7lbf.

* * * * *